US005492433A

United States Patent [19]

Mosier et al.

[11] Patent Number: 5,492,433

[45] Date of Patent: Feb. 20, 1996

[54] TRAVELING SKI GRADE REFERENCE FOR ASPHALT PAVING MACHINE

[75] Inventors: Marta Mosier, Harrisburg; Laikram Narsingh; Terry Toohig, both of Chambersburg, all of Pa.

[73] Assignee: Ingersoll-Rand Company, Woodcliff Lake, N.J.

[21] Appl. No.: 297,453

[22] Filed: Aug. 29, 1994

[51] Int. Cl.[6] ..... E01C 23/01

[52] U.S. Cl. ..... 404/84.1

[58] Field of Search ..... 404/84.1, 84.2, 404/84.8

[56] References Cited

U.S. PATENT DOCUMENTS 5,362,177 11/1994 Bowhall et al. ..... 404/84.1

OTHER PUBLICATIONS

US Army Corpos Of Engineers, "Hot–Mix Asphalt Paving" Handbook UN–13 (CEMP–ET) 31 Jul. 1991, pp. 3–41 thru 3–52.

*Primary Examiner*—William P. Neuder
*Attorney, Agent, or Firm*—John J. Selko

[57] ABSTRACT

A flexible, floating beam, for use with a ground contour averaging apparatus on a paving machine includes a flexible main beam mounted on a paving machine, sliding skis supporting the main beam above the ground at two or more points, the main beam formed from a preselected material having a yield strength, the main beam having a preselected combination of section, moment of inertia, bending moment and deflection, whereby the main beam is characterized by a combination of maximum deflection and an internal stress below the yield strength of the beam material.

7 Claims, 6 Drawing Sheets

$$I=\frac{bd^3-hk^3}{12} \qquad I=\frac{bd^3-h^3(b-t)}{12} \qquad I=\frac{bd^3-h^3(b-t)}{12}$$

TRAVELING SKI GRADE REFERENCE FOR ASPHALT PAVING MACHINE

BACKGROUND OF THE INVENTION

This invention relates generally to grade sensing devices for use with a mobile paving machine, and more particularly to a flexible, floating beam for averaging ground contour, for use with an asphalt paving machine.

Floating beam devices, in order to be useful over a wide variety of ground contours, must combine a balance of maximum deflection and strength characteristics. Too much beam deflection can sacrifice beam strength and result in a beam that is too fragile for rugged use. Too much beam strength can result in a beam that is too inflexible for use over a wide range of ground contour.

The foregoing illustrates limitations known to exist in present floating beams devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a flexible, floating beam, for use with a ground contour averaging apparatus on a paving machine comprising: a flexible main beam; means for mounting the main beam on a paving machine to extend lengthwise alongside of the paving machine; sliding ski means for supporting the main beam above the ground at two or more points, while slidably contacting the ground; the main beam formed from a preselected material having a yield strength, the main beam having a preselected combination of section, moment of inertia, bending moment and deflection, whereby the beam is characterized by a combination of maximum deflection and an internal stress below the yield strength of the material.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
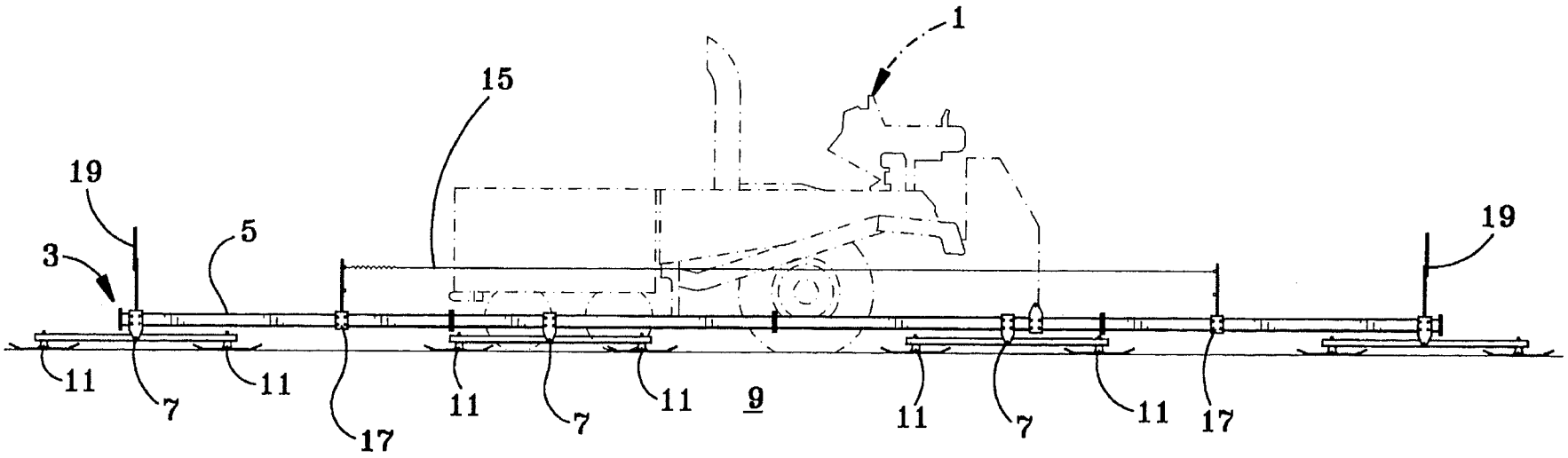
FIG. 1 is a schematic side view of the ground contour averaging apparatus of this invention, with parts removed, mounted on a paving machine shown in phantom.

FIG. 1 shows a mobile paving machine 1, in phantom, with the beam 3 of this invention being pivotally attached thereto. Beam 3 extends alongside of one side of machine 1. Beam 3 comprises a main beam 5 pivotally supported by a plurality of ski sets 7 slidingly contacting the ground 9. Main beam 5 can be a section that is tubular, I-beam or channel. We prefer main beam 5 to be a tubular, aluminum section. Each ski set 7 comprises a pair of sliding skis 11 pivotally connected to a ski bar 13.

Extending above a substantial length of main beam 5 is a grade indicating cable 15 tautly supported between two support members 17. Optional traffic signs 19 are also mounted on main beam 5.

Figure 2:
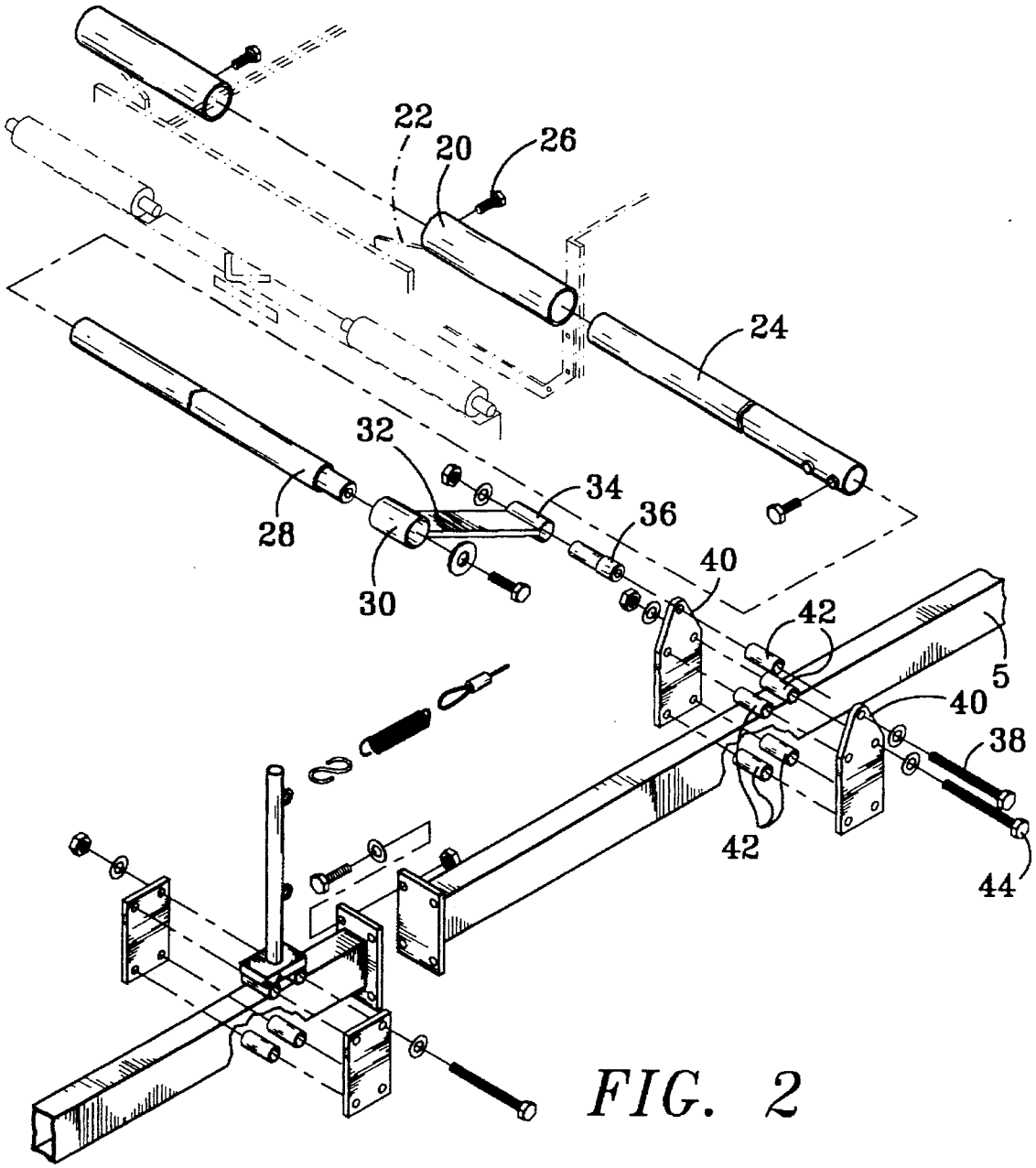
FIG. 2 is an exploded view of a portion of the beam of this invention, showing the connection of the beam to a hopper end of a paving machine.

FIG. 2 shows the pivotal connection of a first end of main beam 5 to the hopper end of the paving machine 1. Tubular member 20 is welded to hopper frame 22. Shaft 24 telescopes into member 20, and is removably held therein by bolts 26. Pivotally mounted on external end 28 of shaft 24 is first end 30 of pivot arm 32. Second end 34 of pivot arm 32 is pivotally mounted on pivot pin 36. Pivot pin 36 is telescoped onto bolt 38 that extends between a pair of upstanding, spaced-apart flanges 40. Flanges 40 are separated by spacers 42 so as not to crush the tubular section of main beam 5, when flanges 40 are bolted together by bolts 44. It will be understood that when bolts 44 and 38 are loosened, main beam 5 can be repositioned lengthwise between flanges 40.

Figure 3:
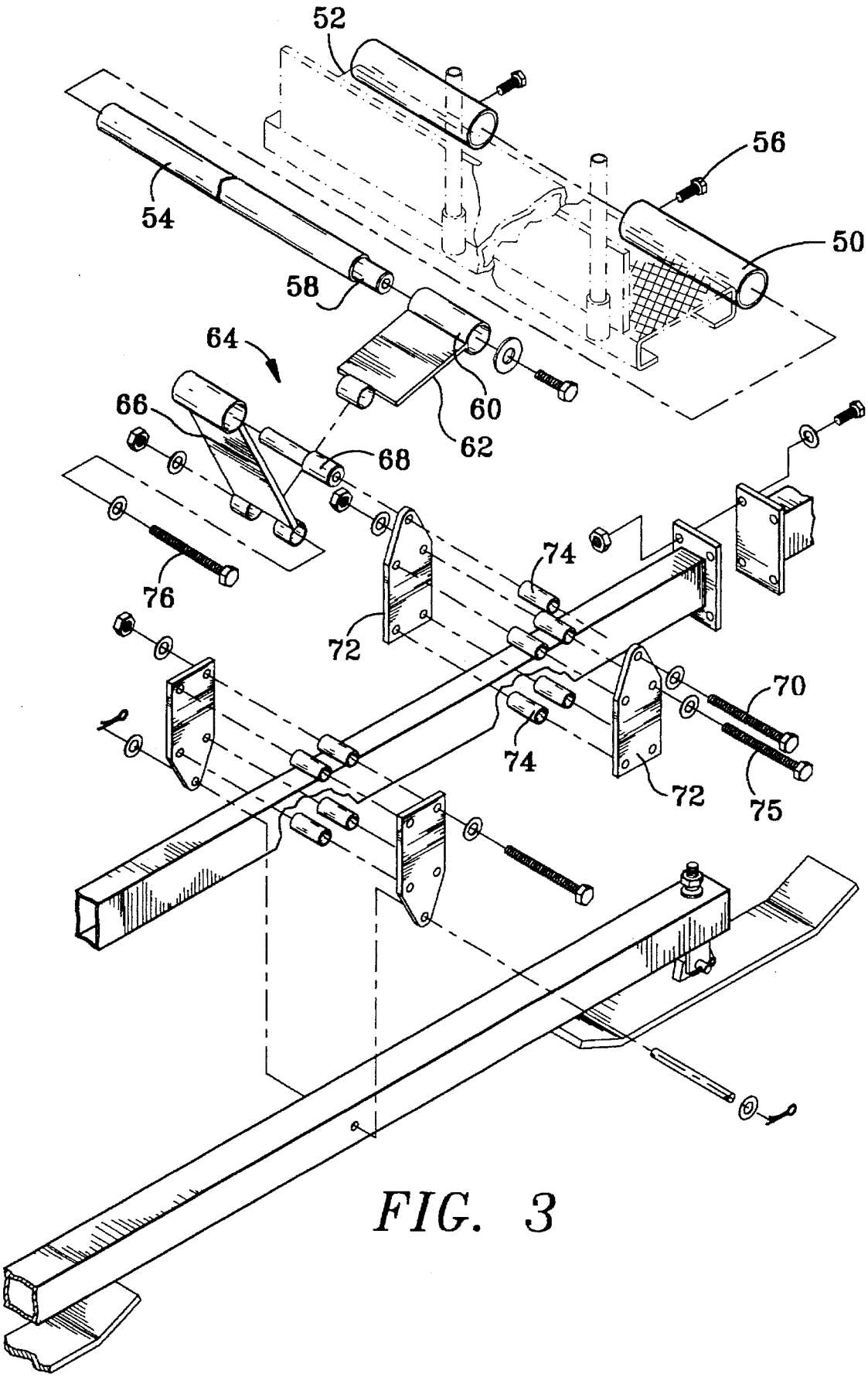
FIG. 3 is a view similar to FIG. 2, showing the connection of the beam to a screed end of a paving machine.

FIG. 3 shows the pivotal connection of a second end of main beam 5 to the screed end of the paving machine 1. Tubular member 50 is welded to screed frame 52. Shaft 54 telescopes into tubular member 50, and is removably held therein by bolts 56. Pivotally mounted on external end 58 of shaft 54 is first end 60 of first hinge arm 62 of hinge 64. Second hinge arm 66 of hinge 64 is pivotally mounted on pivot pin 68. Pivot pin 68 is telescoped onto bolt 70 that extends between a pair of upstanding, spaced-apart flanges 72. Flanges 72 are separated by spacers 74 so as not to crush the tubular section of main beam 5, when flanges 72 are bolted together by bolts 75. Hinge arms 62 and 66 are pivotally connected to hinge pin 76. It will be understood that when bolts 70 and 75 are loosened, main beam 5 can be moved lengthwise between flanges 72.

Figure 4:
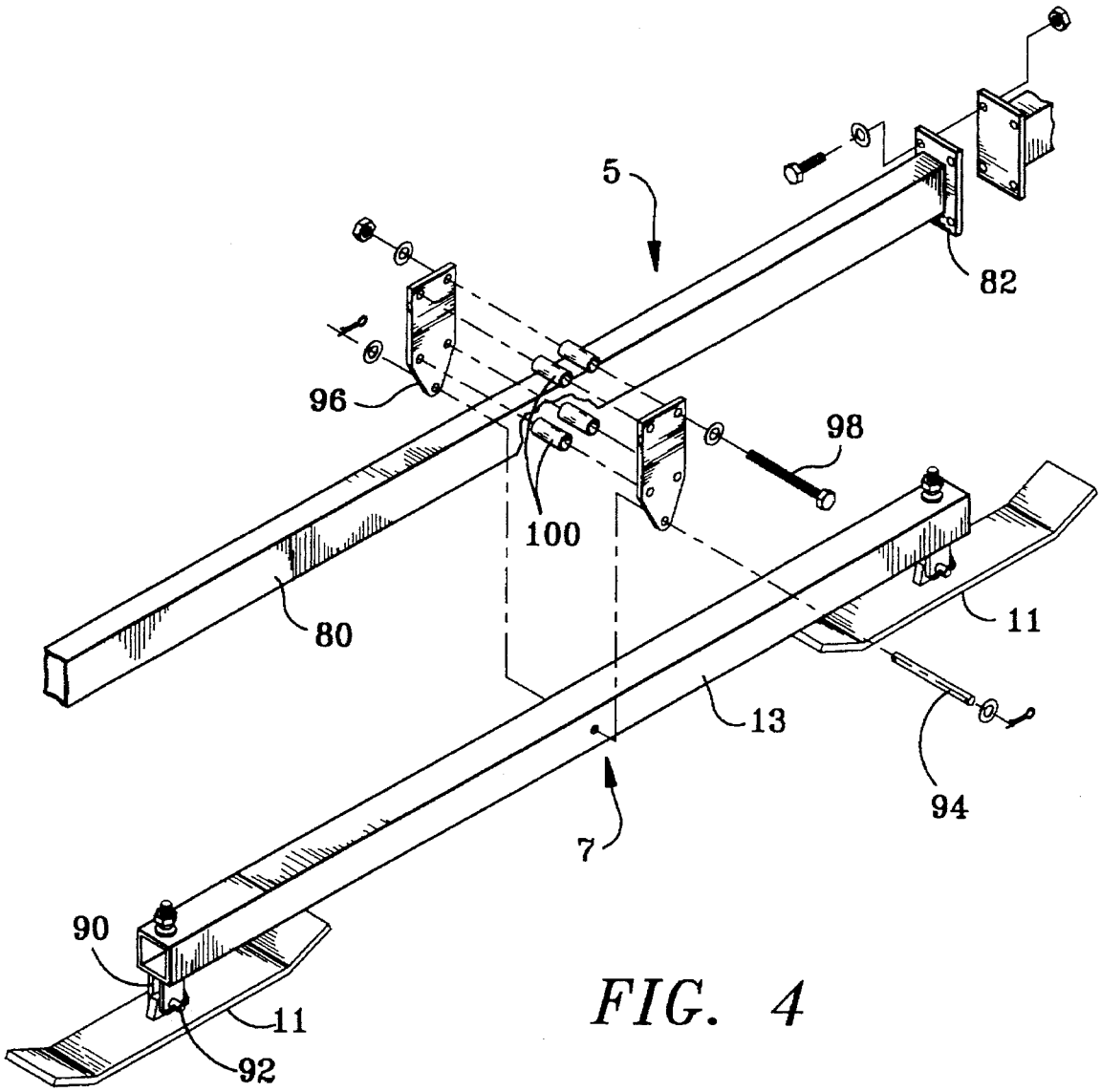
FIG. 4 is a view similar to FIGS. 2 and 3, showing an intermediate beam section.

FIG. 4 shows a section 80 of beam 5 that is joined with other identical sections 80 to form a single beam 5. Each section 80 has a flange 82 welded to each end thereof. Flanges 82 are bolted together to form the desired length of beam 5. We prefer sections 80 to be 10 feet long and beams 5 to be at least 20 feet, and preferably 40 feet. FIG. 4 also shows ski set 7. Ski bar 13 has a ski 11 pivotally connected to each end thereof, by means of spaced-apart ears 90 connected thereto and pivot pin 92 connected to ski 11 at mid-point thereof. Ski bar 13 is pivotally connected to beam 5 by means of pivot pin 94 extending between downwardly extending, spaced-apart flanges 96. Flanges 96 are bolted together on beam 5 by means of bolts 98 and spacers 100, as described hereinabove. Each ski set 7 is similarly pivotally connected to beam 5.

Figure 5:
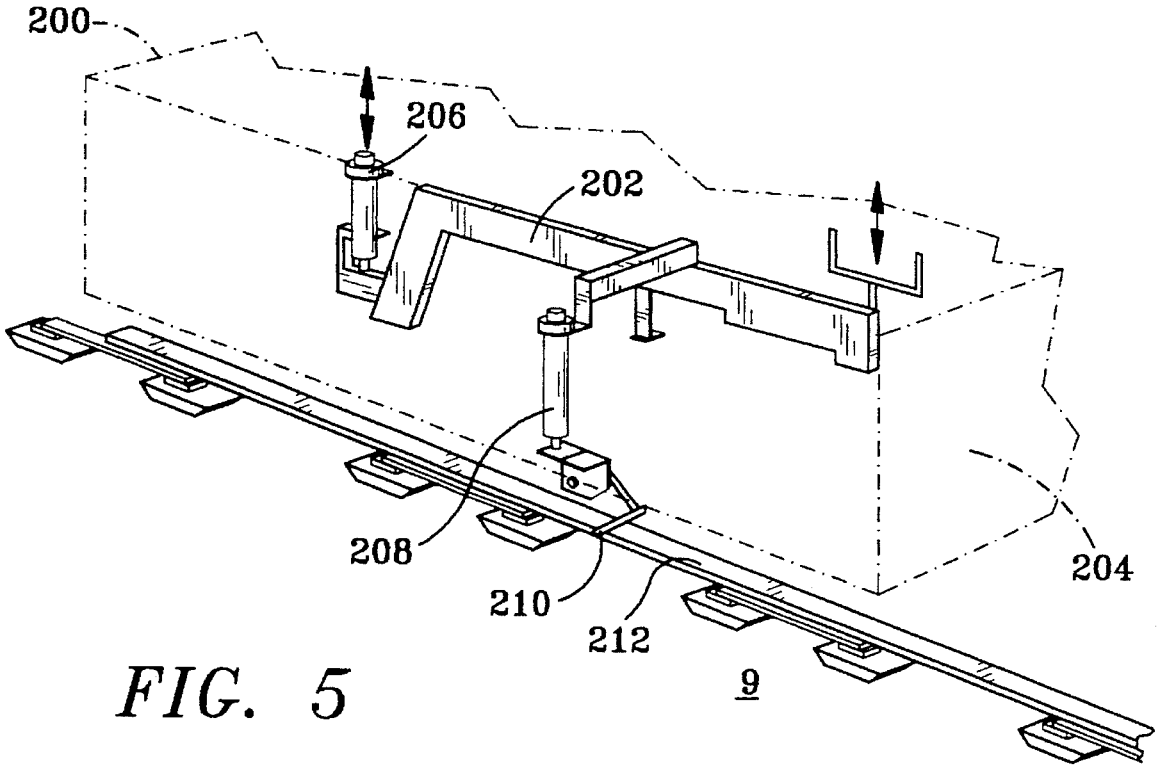
FIG. 5 is a schematic sketch of a prior art system for sensing ground contour and for adjusting a paving machine in response thereto.

For purposes of illustration, FIG. 5 is a schematic sketch of a conventional system for sensing ground contour and for adjusting a paving machine in response thereto. This system can be used with the beam of this invention. A paving machine 200 (shown in phantom) has a leveling arm 202 connected to a screed portion 204 of the machine. Automatic grade control uses the tow point cylinder 206 attached to leveling arm 202. The tow point cylinder 206 adjusts the screed angle of attack relative to the ground 9. This determines the depth of asphalt being laid. The tow point cylinder movement is controlled by flow from electrical control valves (not shown). The valves receive their signals from the grade controller 208 mounted on the leveling arm 202. The signals are generated according to the angle of the sensor arm 210 that rides on the averaging ski stringline 212. The stringline moves up and down relative to the grade controller 208 as it averages the ground profile it rides over. The asphalt depth, laid, therefore, will follow the average of the ground profile under the ski. This creates a smooth road surface.

Figure 6:
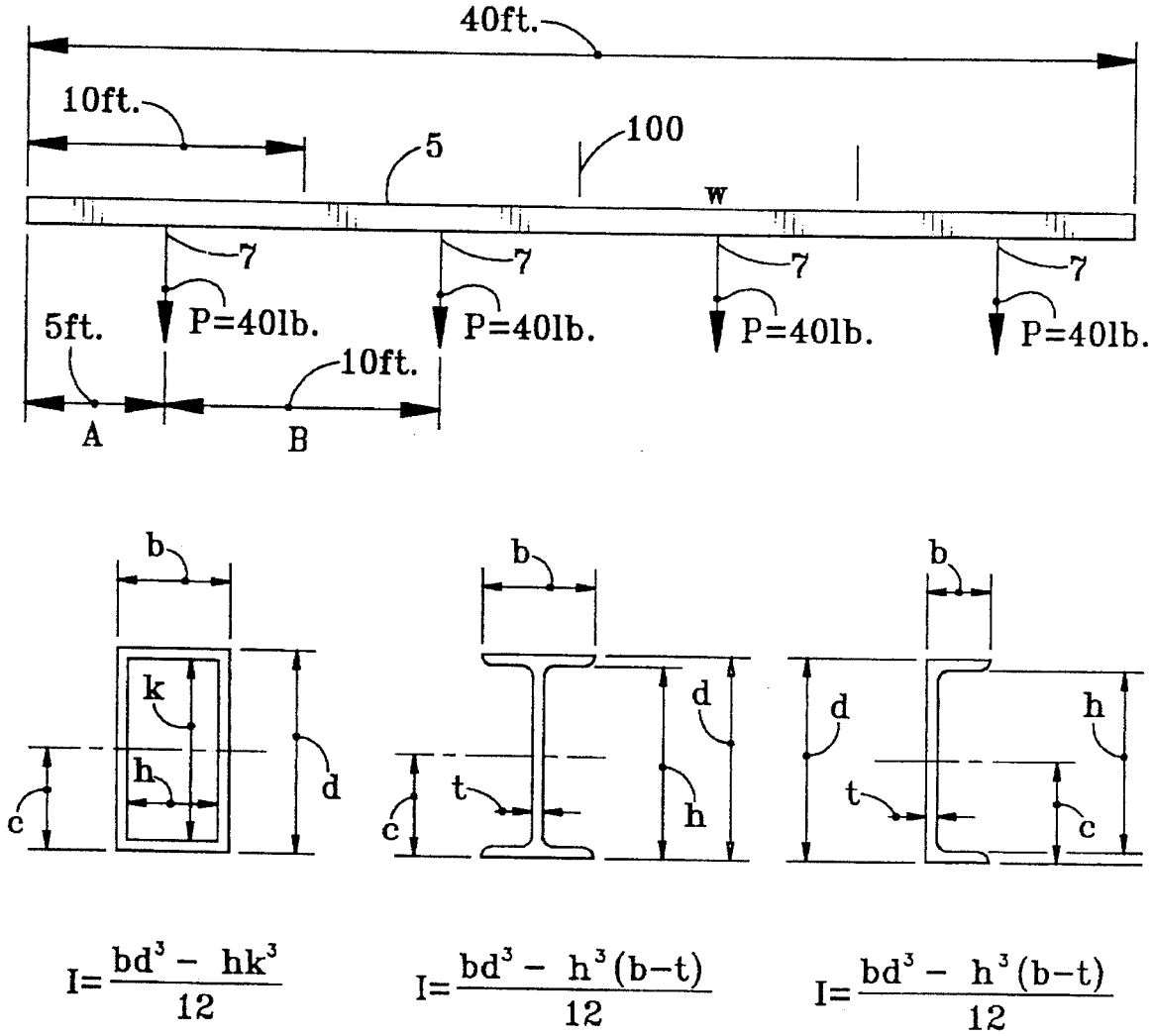
FIG. 6 is a schematic sketch showing the beam sections used for this invention, the formulas for the moments of inertia moments of these sections and the beam loading arrangement used to determine the characteristics of the beam of this invention.

Now referring to FIG. 6 the preferred arrangement of beam 5 of this invention is shown. Beam 5 is 40 feet in length, being supported on 4 ski sets 7, being spaced apart by 10 feet, as arranged symmetrically with respect to the mid-point 100 of beam 5. Ski sets 7 are also of aluminum, and weigh 40 pounds each.

PREFERRED EXAMPLE

FIG. 6 shows the beam sections used for this invention, the formulas for the moments of inertia moments of these sections and the beam loading arrangement used to determine the characteristics of the beam of this invention.

Table I shows the characteristics of the sections that can be used for this invention.

TABLE I

| Aluminum Section | Wide b (in) | High d (in) | Thickness t (in) | Weight W (lb/in) | Moment Of Interia I ($in^4$) | Deflection Max Δ max (in) | Bending Stress σ ($lb/in^2$) |
|---|---|---|---|---|---|---|---|
| Rectangular | 2 | 3 | .125 | .1188 | 1.467 | 21.793 | 13314.35 |
| Retangular | 2 | 4 | .125 | .1408 | 2.9762 | 11.204 | 9176.15 |
| Rectangular | 2 | 6 | .125 | .1899 | 8.2757 | 4.439 | 5462.66 |
| Rectangular | 2 | 8 | .125 | .2437 | 17.45 | 2.3186 | 3809.41 |
| I-Beam | 2.66 | 4 | .190 | .22 | 4.422 | 8.779 | 7207.59 |
| I-Beam | 3 | 5 | .21 | .2858 | 8.9132 | 4.8658 | 5001.30 |
| I-Beam | 3.33 | 6 | .23 | .3583 | 16.015 | 3.021 | 3731.32 |
| Channel | 2.25 | 4 | .19 | .1941 | 3.8564 | 9.602 | 7877.85 |
| Channel | 2.75 | 5 | .19 | .2575 | 7.6087 | 5.443 | 5590.96 |
| Channel | 3.25 | 6 | .25 | .3358 | 14.4855 | 3.2326 | 3991.10 |

For Aluminum σy = 21,000 $lb/in^2$
σ = Yield Strength

The moments of inertia are determined by the formula shown in FIG. 6. For the load distribution of the beam of FIG. 6, the maximum deflection of the beam is determined as follows:

$$\Delta max = \frac{PA}{24EI}(3L^2 - 4A^2) + \frac{PB}{24EI}(3L^2 - 4B^2) + \frac{5WL^4}{384EI}$$

The maximum bending moment of the beam is determined as follows:

$$M\,max = PA + P + \frac{WL^2}{8}$$

The internal bending stress from the beam loading is determined as follows:

$$\sigma_b = \frac{M\,max\,C}{I}$$

C=Distance from neutral axis to the outermost fiber of the section.

I=Moment of inertia.

E=Modulus of eleasticity (for aluminum $E=10\times10^6$ $lb/in^2$)

The widest range of ground contour that can be averaged by a beam 5 is obtained be providing a main beam 5 formed from a preselected material (aluminum), with the main beam 5 having a preselected combination of section, moment of inertia, bending moment and deflection, whereby the main beam 5 is characterized by a combination of maximum deflection and an internal stress below the yield strength of the aluminum material.

Table I shows the preferred sections that provide maximum deflection for the beam sections that can be used for this invention. Thus, as shown in Table I for example, the 2×3 rectangular section will provide the maximum deflection. However, the 2×3 section moment of inertia is low, meaning that the beam 5 will be subject to deformation due to field conditions, such as being struck or run over by moving vehicles. Therefore, we prefer to provide a design safety factor by selecting a section that provides an internal bending stress (at maximum deflection) that is less than 60% of the yield strength of the material. Therefore, in Table I, the preferred section is rectangular 2×4. The next preferred sections are: channel 2.25×4 and I-Beam 2.66×4.

Having described the invention, what is claimed is:

1. A flexible, floating beam, for use with a ground contour averaging apparatus on a paving machine, said beam comprising:

a. a flexible main beam;

b. sliding ski means for supporting said main beam above the ground at two or more points, while slidably contacting the ground;

c. said main beam formed from a preselected material;

d. said main beam having a preselected section selected from the group consisting essentially of a rectangular section, an I-beam section and a channel section;

e. said main beam having a preselected maximum deflection in the range of about 8.7 to 11.2 inches caused by said main beam weight and said ski means weight; and f. said preselected section having a preselected moment of inertia in the range of about 2.9 to 4.4, such that at said preselected maximum deflection of said main beam, said preselected section has an internal stress that does not exceed the yield strength of said preselected material.

2. The beam of claim 1 wherein the internal stress of said preselected section does not exceed 60% of the yield strength of said preselected material.

3. The beam of claim 1 wherein said preselected material is aluminum.

4. The beam of claim 3 wherein said section is a rectangular section.

5. The beam of claim 3 wherein said section is an I-Beam section.

6. The beam of claim 3 wherein said section is a channel section.

7. The beam of claim 3 wherein said main beam is at least twenty feet long.

* * * * *